US006105255A

United States Patent [19]

Cheng

[11] Patent Number: 6,105,255

[45] Date of Patent: Aug. 22, 2000

[54] FOLDING KNIFE

[75] Inventor: Yang-Fu Cheng, Taipei, Taiwan

[73] Assignee: Kantas Products Co., Ltd., Taiwan

[21] Appl. No.: 09/295,585

[22] Filed: Apr. 22, 1999

[51] Int. Cl.[7] ..... B26B 1/04

[52] U.S. Cl. ..... 30/161; 30/155; 30/159; 30/160; 30/340; 30/342; 81/177.9

[58] Field of Search ..... 30/161, 155, 159, 30/160, 342, 340; 81/177.9

[56] References Cited

U.S. PATENT DOCUMENTS

| | | | |
|---|---|---|---|
| 4,896,424 | 1/1990 | Walker | 30/161 |
| 5,461,786 | 10/1995 | Miller | 30/161 |
| 5,537,750 | 7/1996 | Seber et al. | 30/161 |
| 5,699,615 | 12/1997 | Chen | 30/160 |

*Primary Examiner*—M. Rachuba
*Assistant Examiner*—Sean Pryor
*Attorney, Agent, or Firm*—Bacon & Thomas PLLC

[57] ABSTRACT

A folding knife with a blade having a bottom end edge and a handle grip portion. The blade is pivotally mounted at one end of the handle grip portion. The handle grip portion has a hollow slot. The folding knife includes a leaf spring with first and second ends and a protruding member. The first end of the leaf spring is connected to the handle grip portion and the leaf spring substantially extends along a length of the slot and the second end of the leaf spring is configured to abut against the bottom end edge of the blade and lock the blade firmly in place when the blade is fully extended out of the handle grip portion. The device includes a steel ball positioned on the protruding member and a cover plate having a through bore. The cover plate is mounted on the handle grip portion securing the steel ball between the protruding member and outer edges of the through bore.

3 Claims, 3 Drawing Sheets

FOLDING KNIFE

BACKGROUND OF THE INVENTION

1. Field of the Invention

The present invention relates to an improved handle structure for a folding knife, in which a handle grip portion has a blade pivotally mounted at one end and a leaf spring at the center thereof. A cover plate is mounted on the handle grip portion. The cover plate includes a through-hole thereon for insertion of a steel ball. By pressing down the steel ball, the blade is folded to be received in a space formed between the handle grip portion and the cover plate. Hence, it is not required for a user to apply much force to press down the leaf spring for folding the blade, and prevents the user from cutting his/her fingers by such an action 2. Description of the Prior Art As shown in FIG. 1, a conventional handle 1 for folding knife generally includes a handle grip portion 10 having a blade pivotally mounted at one end and a hollow slot 12 at the center thereof. The slot 12 extends below a pivoting portion 13 of the blade 11, and a leaf spring 14 is provided on the handle grip portion 10. An end of the leaf spring 14 is slightly bent upward to form a stop 15. The stop 15 is adapted for abutting against an end edge of the pivoting portion 13 of the blade 11 to hold the blade 11 in place when in the opened position.

A raised post 16 is formed on the upper side of the handle grip portion 10 at a place adjacent to the blade 11, making the blade 11 held firmly relative to the handle grip portion 10, when in the extended condition. Further, a plurality of notches 17 are provided on the leaf spring 14 at the side which does not abut against the blade 11. These notches 17 are used to increase the elasticity of the leaf spring 14.

As shown in FIGS. 2 and 3, if a user applies a given force by his/her index finger when he/she holds the handle grip portion 10, the leaf spring 14 will be pressed down, causing the stop 15 of the leaf spring 14 to be separated from the end edge of the pivoting portion 13 of the blade 11. In the meantime, a force applied by the user's thumb to the back of the blade 11 will make the blade 11 folded suddenly, and such an action is likely to cut the fingers of the user. Consequently, conventional handle for folding knife is dangerous to the user's fingers in use.

SUMMARY OF THE INVENTION

The present invention has been accomplished in order to overcome the disadvantages found in the prior art. According to the present invention, it provides an improved handle structure for a folding knife, which comprises a handle grip portion having a blade pivotally mounted at one end and a hollow slot at the center thereof. A leaf spring is provided within the slot, having an end thereof connected to the handle grip portion. A cover plate is mounted on the handle grip portion. The cover plate includes a through-hole thereon for insertion of a steel ball. When the blade is in the extended condition, the bottom end edge of the handle grip portion abuts against another end of the leaf spring to hold the blade in place. When the blade is to be folded, the leaf spring goes downward by pressing down the steel ball, causing the end of the leaf spring to be separated from the bottom end edge of the handle grip portion, thereby bolding the blade. Hence, it is not required for a user to apply much force to press down the leaf spring for folding the blade, and prevents the user from cutting his/her fingers by such an action.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
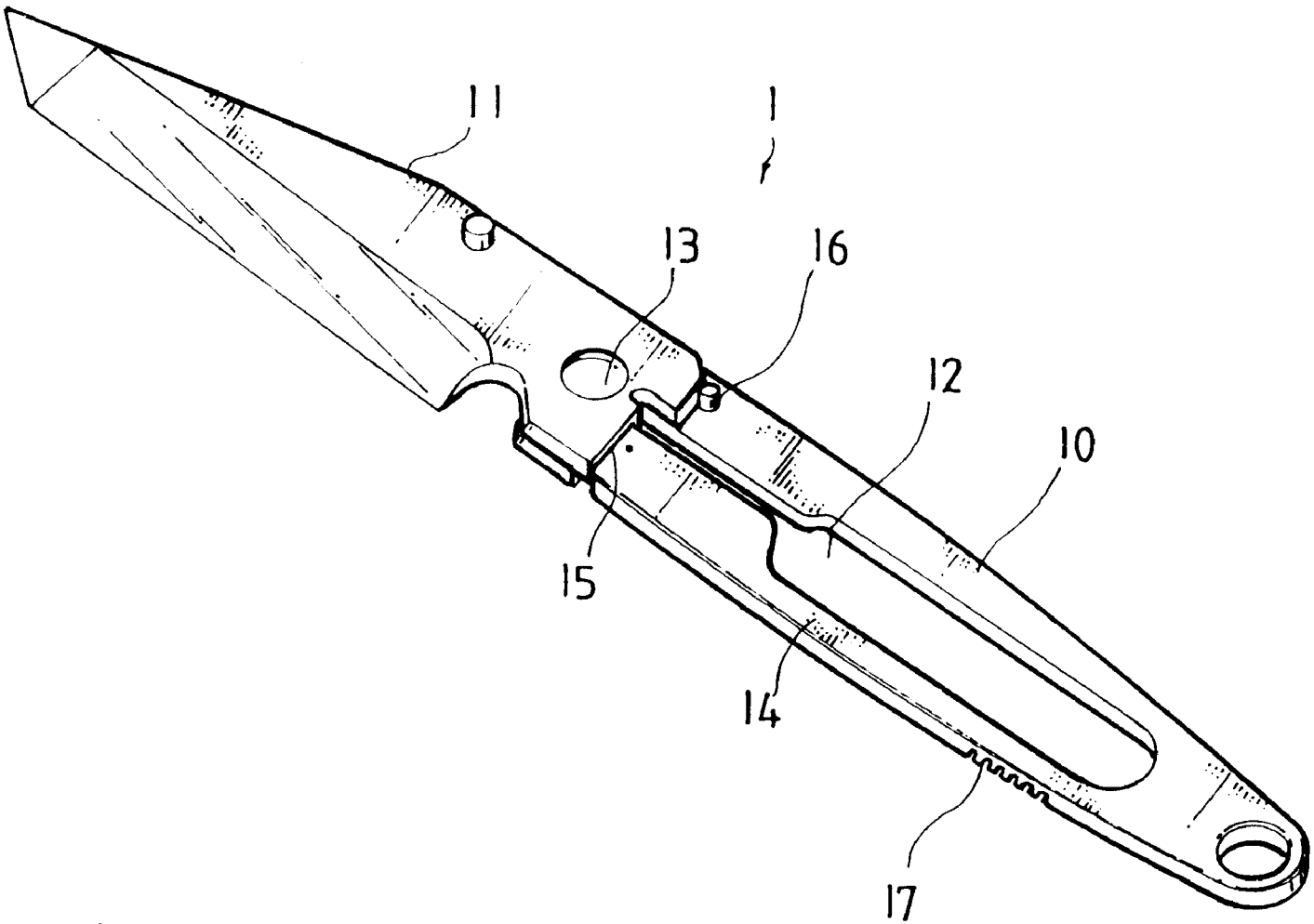
Fig. 1 Prior Art
FIG. 1 is a perspective view of the prior art.
Figure 3:
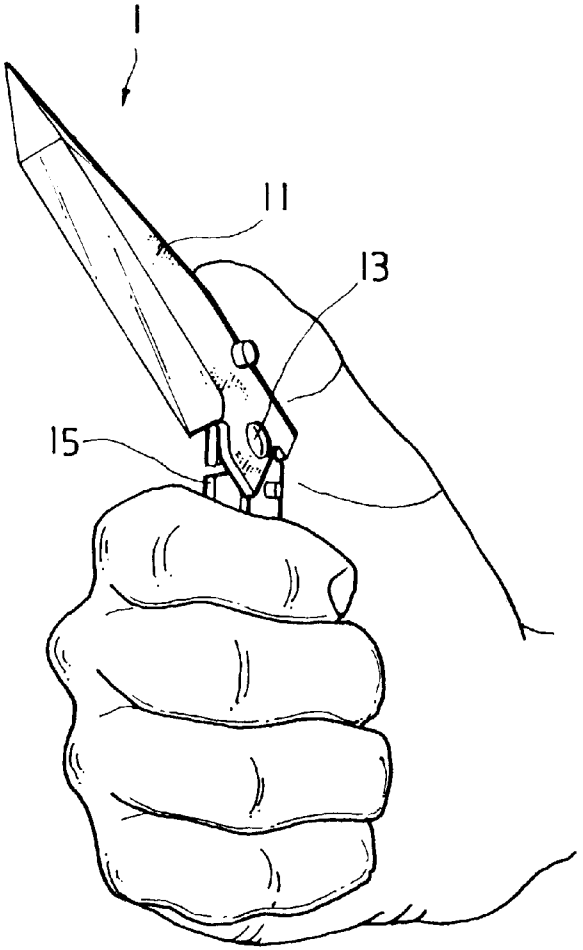
Fig. 3 Prior Art
FIG. 3 is another schematic view showing the folding knife of FIG. 2 in a partially folded position.
Figure 2:
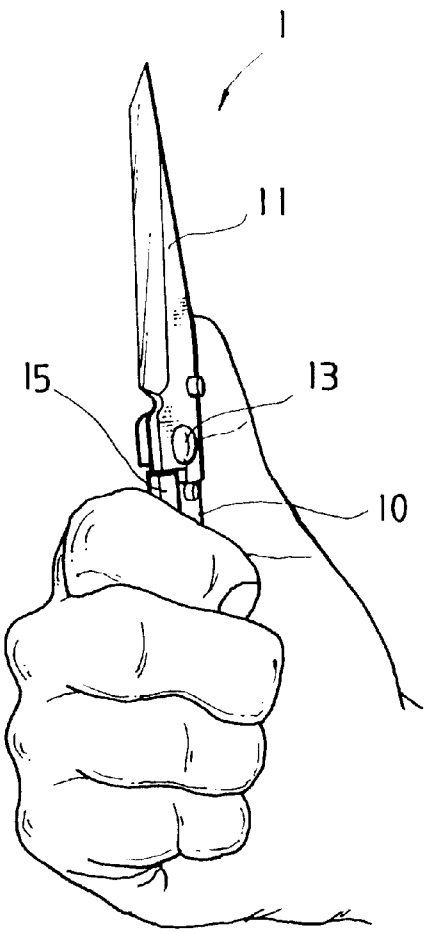
Fig. 2 Prior Art
FIG. 2 is a schematic view showing a prior art folding knife with the blade fully extended.
Figure 4:
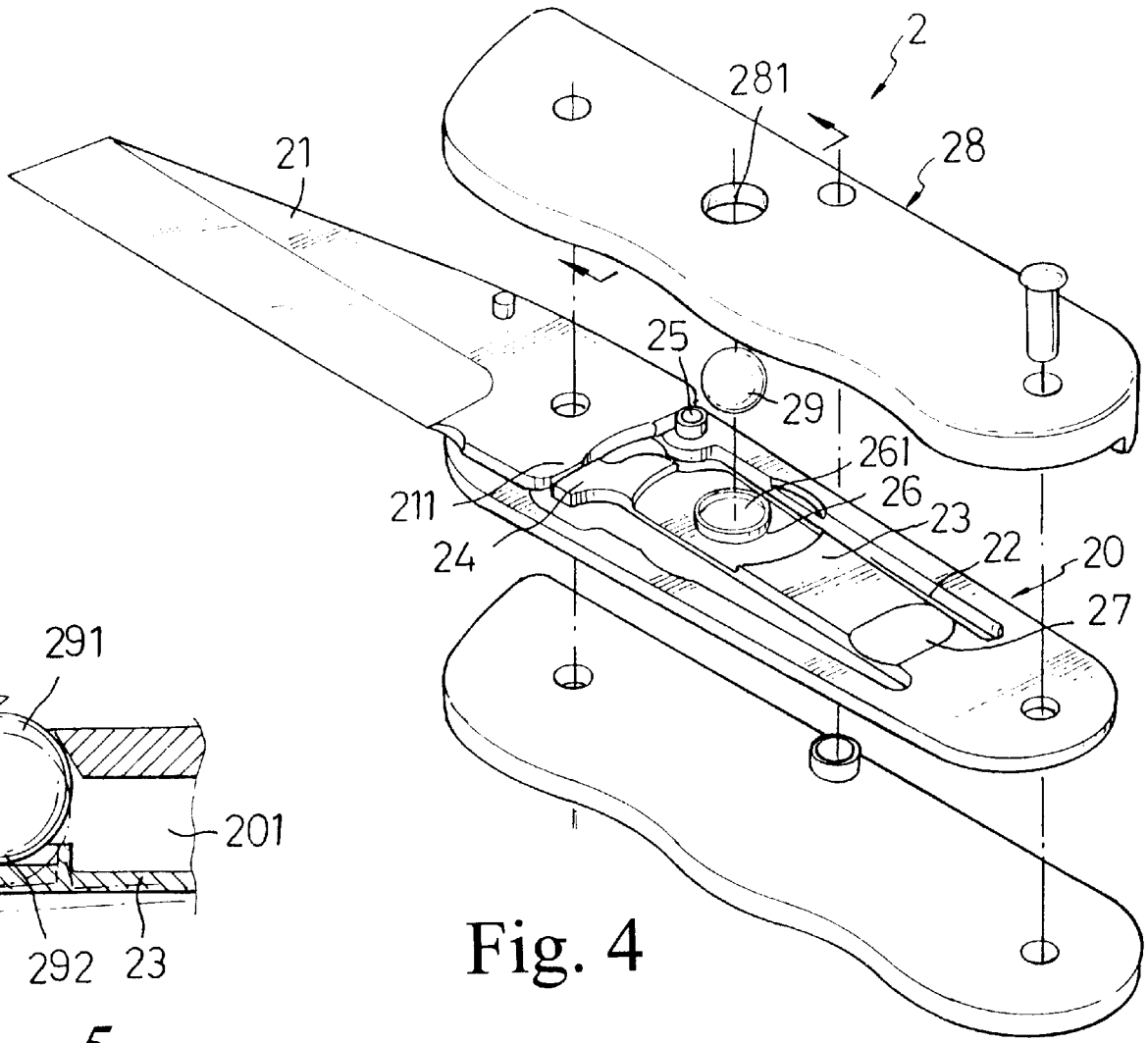
FIG. 4 is a partially exploded view of the present invention.
Figure 5:
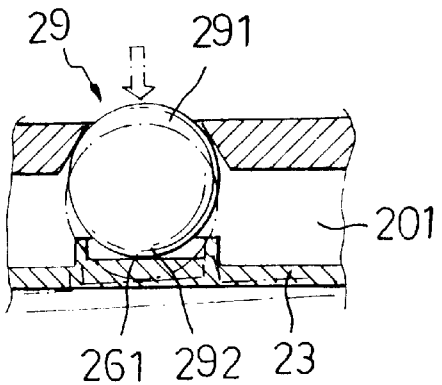
FIG. 5 is a partial cross-sectional view of the present invention.

Referring to FIGS. 4 and 5, a preferred embodiment of an improved handle structure for folding knife in accordance with the present invention includes a handle 2 having a handle grip portion 20 generally in the form of a flat plate. A blade 21 is pivotally connected to one end of the handle grip portion 20, and a generally U-shaped hollow slot 22 is disposed about at the center of the handle grip portion 20. A leaf spring 23 is provided at a place surrounded by the slot 22, having an end connected to the handle grip portion 20 and an opposite end slightly bent upward to form a stop 24. The stop 24 abuts against a bottom end edge 211 of the blade 21 to hold the blade 21 in place when in the opened position.

A raised post 25 is formed on the upper side of the handle grip portion 20 at a place adjacent to the blade 21, keeping the blade 21 in position relative to the handle grip portion 20 when in the extended condition. Further, a circular cavity 26 with a hollow protruding member 261 is provided on the leaf spring 23 at a place adjacent to an end thereof, and a dent 27 is made at the other end of the leaf spring 23 to increase the elasticity of the leaf spring 23.

There is a cover plate 28 being mounted on the handle grip portion 20. The cover plate 28 includes a through-bore 281 thereon at a place corresponding to the protruding member 261 of the leaf spring 23. As shown in FIG. 5, the through-bore 281 has its upper diameter smaller than its lower diameter, so that a steel ball 29 with a diameter slightly larger than the upper diameter of the through-bore 281 can be steadily held in the through-bore 281 to prevent from slipping off. The steel ball 29 has its top 291 projected out of the through-hole 28, thus facilitating a user to press down the steel ball 29 by his/her thumb. On the other hand, the steel ball 29 has its bottom 292 abutted against the protruding member 261 on the circular cavity 26 of the leaf spring 23, causing the leaf spring 23 to go downward when the user presses down the steel ball 29.

In use, if the blade 21 is in the extended condition, its bottom end edge 211 abuts against the stop 24 of the leaf spring 23, thus holding the blade 21 in place. When folding the blade 21, a user may press down the top 291 of the steel ball 29 with his/her thumb. Consequently, the bottom 292 of the steel ball 29 will, in turn, press down the protruding member 261 of the leaf spring 23 to make the stop 24 of the leaf spring 23 separated from the bottom end edge 211 of the blade 21. At this moment, by using the index finger to press the back of the blade 21, the blade 21 is then folded and received in the space 201 formed between the handle grip portion 20 and the cover plate 28.

According to the present invention, the cover plate 28 mounted on the handle grip portion 20 and the steel ball 29 permit the folding of the blade to occur in a safe manner. Therefore, it is not required for a user to apply much force on the steel ball 29 to press down the leaf spring 23 for folding the blade 21, thus preventing the user from cutting his/her fingers by such an action as is often seen in conventional folding knives. Also, the overall structure of the present invention enables the user to hold the handle of the folding knife more firmly, making the blade 21 easier to be closed, thereby increasing the convenience of its use.

Although the present invention has been illustrated and described with reference to the preferred embodiment thereof, it should be understood that it is in no way limited to the details of such embodiment but is capable of numerous modifications within the scope of the appended claims.

What is claimed is:

1. A folding knife, comprising:

a blade having a bottom end edge;

a handle grip portion, the blade pivotally mounted at one end of the handle grip portion, the handle grip portion having a hollow slot;

a leaf spring having first and second ends and a protruding member, the first end of the leaf spring connected to the handle grip portion and the leaf spring substantially extending along a length of the slot and the second end of the leaf spring configured to abut against the bottom end edge of the blade and lock the blade firmly in place when the blade is fully extended out of the handle grip portion;

a steel ball positioned on the protruding member; and a cover plate having a through bore, the cover plate mounted on the handle grip portion securing the steel ball between the protruding member and outer edges of the through bore.

2. The improved folding knife as recited in recited in claim 1, wherein the through bore has a diameter that is smaller than the diameter of the steel ball.

3. The folding knife as recited in recited in claim 1, wherein the steel ball has a top portion that projects out of the through bore and is configured to allow a user to press down on the steel ball to cause the leaf spring to bend downwards causing the second end of the leaf spring to unlock the bottom end edge of the blade and permit the user to push and house the blade substantially between the hand grip portion and the cover plate.

* * * * *